US008877416B2

(12) United States Patent
Ariyoshi et al.

(10) Patent No.: US 8,877,416 B2
(45) Date of Patent: Nov. 4, 2014

(54) TONER AND METHOD FOR MANUFACTURING THE SAME

(75) Inventors: Satoru Ariyoshi, Osaka (JP); Yasuhiro Shibai, Osaka (JP); Katsuru Matsumoto, Osaka (JP); Nobuhiro Maezawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 474 days.

(21) Appl. No.: 13/157,087

(22) Filed: Jun. 9, 2011

(65) Prior Publication Data

US 2011/0305985 A1 Dec. 15, 2011

(30) Foreign Application Priority Data

Jun. 11, 2010 (JP) ..... P2010-134598

(51) Int. Cl.
*G03G 9/08* (2006.01)
*G03G 9/087* (2006.01)
*G03G 9/097* (2006.01)

(52) U.S. Cl.
CPC ..... *G03G 9/08755* (2013.01); *G03G 9/08793* (2013.01); *G03G 9/081* (2013.01)
USPC ..... 430/109.4; 430/108.1; 430/108.3

(58) Field of Classification Search
USPC ..... 430/108.1, 109.4, 111.35
See application file for complete search history.

(56) References Cited

U.S. PATENT DOCUMENTS

| | | | | |
|---|---|---|---|---|
| 5,968,689 | A | 10/1999 | Torikoshi et al. | |
| 2003/0203301 | A1 | 10/2003 | Iga | |
| 2005/0147911 | A1 | 7/2005 | Shirai et al. | |
| 2008/0057430 | A1 | 3/2008 | Takahashi et al. | |
| 2009/0162772 | A1 | 6/2009 | Fuwa et al. | |
| 2009/0297973 | A1* | 12/2009 | Iwamoto et al. | 430/108.1 |
| 2010/0068644 | A1 | 3/2010 | Nakajima et al. | |
| 2011/0123922 | A1 | 5/2011 | Yamane et al. | |
| 2011/0305982 | A1 | 12/2011 | Matsumoto et al. | |
| 2011/0305988 | A1 | 12/2011 | Ariyoshi et al. | |

FOREIGN PATENT DOCUMENTS

| | | | |
|---|---|---|---|
| CN | 101140431 | A | 3/2008 |
| CN | 101464639 | A | 6/2009 |
| JP | 2001-013715 | | 1/2001 |
| JP | 2001-117284 | | 4/2001 |
| JP | 2003-322997 | | 11/2003 |
| JP | 2005-195805 | | 7/2005 |
| JP | 2007-293327 | | 11/2007 |
| JP | 2008-310284 | | 12/2008 |
| JP | 2009-020487 | A | 1/2009 |
| JP | 2008-122509 | | 5/2009 |
| JP | 2010-20170 | | 1/2010 |
| JP | 2010-66641 | | 3/2010 |
| JP | 2010-107678 | | 5/2010 |

OTHER PUBLICATIONS

Machine Transaltion of JP 2009-020487 A (Jan. 2009).

* cited by examiner

*Primary Examiner* — Jonathan Jelsma
(74) *Attorney, Agent, or Firm* — Nixon & Vanderhye P.C.

(57) ABSTRACT

A toner includes a binder resin, a colorant, and a benzilic acid compound. The binder resin contains a polyester resin A obtained by subjecting aromatic dicarboxylic acid, rosin and trivalent or higher-valent alcohol as starting materials to polycondensation, a content of the rosin in a sum of the starting materials being 60% by weight or more, and a polyester resin B obtained by subjecting aromatic dicarboxylic acid and polyhydric alcohol as starting materials to polycondensation.

2 Claims, 1 Drawing Sheet

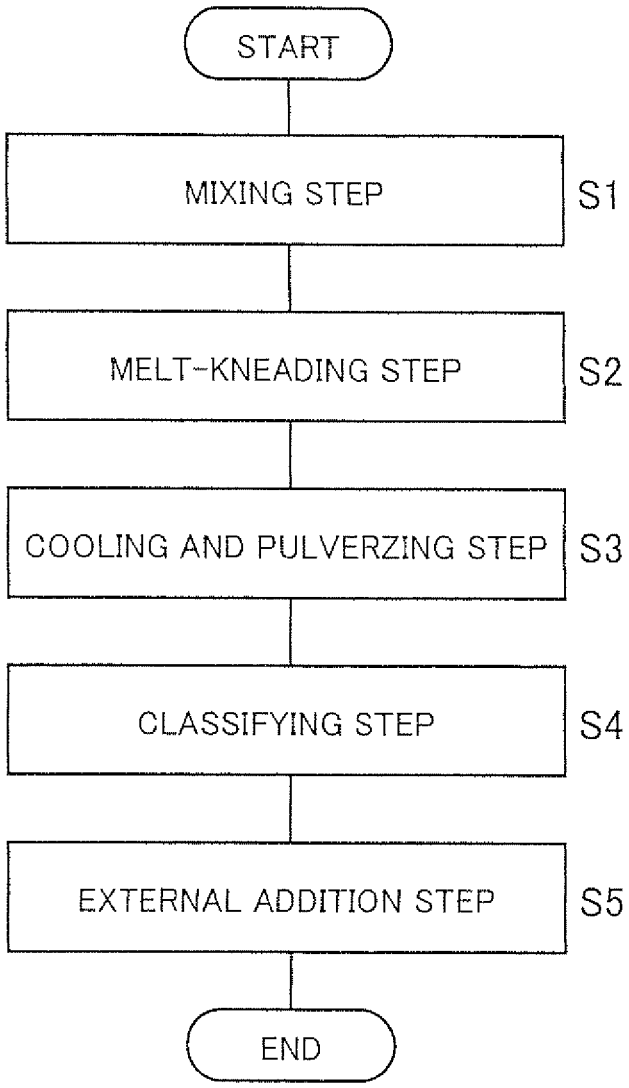
START
MIXING STEP
S1
MELT-KNEADING STEP
S2
COOLING AND PULVERZING STEP
S3
CLASSIFYING STEP
S4
EXTERNAL ADDITION STEP
S5
END

TONER AND METHOD FOR MANUFACTURING THE SAME

CROSS-REFERENCE TO RELATED APPLICATION

This application claims priority to Japanese Patent Application No. 2010-134598, which was filed on Jun. 11, 2010, the contents of which are incorporated herein by reference in its entirety.

BACKGROUND OF THE TECHNOLOGY

1. Field of the Technology

The present technology relates to a toner and a method for manufacturing the same.

2. Description of the Related Art

Toners for visualizing latent images are used in various image forming processes and for example, are used in an electrophotographic image forming process.

In general, in image forming apparatuses employing the electrophotographic image forming process, a desired image is formed on a recording medium by executing a charging step, an exposure step, a developing step, a transfer step, a fixing step and a cleaning step.

At the charging step, a photosensitive layer on the surface of a photoreceptor drum serving as a latent image bearing member is charged uniformly. At the exposure step, signal light of an original image is projected on the surface of the photoreceptor drum that is being charged to form an electrostatic latent image. At the developing step, a toner is agitated to be charged, and the charged toner is supplied onto the surface of the photoreceptor drum so as to visualize the electrostatic latent image. At the transfer step, a toner image on the surface of the photoreceptor drum is transferred to a recording medium such as paper and OHP sheets. At the fixing step, the toner image is fixed onto the recording medium under heat, pressure and the like. At the cleaning step, the toner and the like remaining on the surface of the photoreceptor drum after the toner image is transferred are eliminated and cleaned with a cleaning blade. Transfer of the toner image to a recording medium may be performed through an intermediate transfer medium.

The electrophotographic toner for use in such image formation is manufactured, for example, by a knead-pulverization method, a polymerization method represented by a suspension polymerization method, an emulsification polymerization method and the like. Among them, in the knead-pulverization method, the toner is manufactured in such a manner that toner materials including a binder resin and a colorant as main components, to which a release agent, a charge control agent and the like are added as necessary and mixed, are melt-kneaded, cooled and solidified, then subjected to pulverization and classification.

In recent years, numerous efforts have been made in various technical fields from a viewpoint of global environmental protection. Today, oil is used as materials of many products, and energy is necessary for manufacturing and burning such materials, and carbon dioxide is generated. Efforts for reducing such energy and carbon dioxide are very important as global warming countermeasures.

For new efforts for reducing carbon dioxide as global warming countermeasures, much attention has been focused on the use of a plant-derived resource called biomass. Because the carbon dioxide generated in burning the biomass originates from the carbon dioxide which was present in the atmosphere and was taken in a plant through photosynthesis, the whole balance of input and output amounts of the carbon dioxide in the atmosphere is zero. In this manner, the property which does not affect an increase and a decrease in the carbon dioxide in the atmosphere is called carbon-neutral, and the use of the biomass having the carbon-neutral property is not considered to increase the amount of the carbon dioxide in the atmosphere. The biomass material made from such biomass is called by terms, such as a biomass polymer, a biomass plastic, or an oil-free polymer material, and the material of such biomass material is a monomer called a biomass monomer.

Also in the electrophotographic field there have been made many efforts to use the biomass which is a resource excellent in environmental safety and effective for suppressing an increase in the carbon dioxide.

For example, Japanese Unexamined Patent Publication JP-A 2008-122509 discloses a resin composition for an electrophotographic toner capable of obtaining an electrophotographic toner which contains a polyester resin having a softening temperature of 80 to 120° C. which is obtained from rosin as an essential component, and a polyester resin having a softening temperature of 160° C. or higher which obtained from a polyepoxy compound as an essential component, and has low-temperature fixability, a hot-offset resistance and development durability.

However, in the toner that is disclosed in Japanese Unexamined Patent Publication JP-A 2008-122509, when a rosin content in the resin composition for an electrophotographic toner is further increased in order to enhance utilization rate of biomass, preservation stability of the toner is deteriorated. There is a problem that in such a toner, at a developing step, toner particles are aggregated to each other at the time of agitating of the toner, and a charge amount is not stabilized.

SUMMARY OF THE TECHNOLOGY

An object of the technology is to provide a toner excellent in charging stability even when a rosin content is increased.

Furthermore, an object of the technology is to provide a method of manufacturing a toner excellent in charging stability even when a rosin content is increased.

The technology provides a toner comprising:

a binder resin containing a polyester resin A obtained by subjecting aromatic dicarboxylic acid, rosin and trivalent or higher-valent alcohol as starting materials to polycondensation, a content of the rosin in a sum of the starting materials being 60% by weight or more, and a polyester resin B obtained by subjecting aromatic dicarboxylic acid and polyhydric alcohol as starting materials to polycondensation;

a colorant; and a benzilic acid compound.

A toner comprises a binder resin, a colorant and a benzilic acid compound. The binder resin contains a polyester resin A obtained by subjecting aromatic dicarboxylic acid, rosin and trivalent or higher-valent alcohol as starting materials to polycondensation, a content of the rosin in a sum of the starting materials being 60% by weight or more, and a polyester resin B obtained by subjecting aromatic dicarboxylic acid and polyhydric alcohol as starting materials to polycondensation, which polyester resin B does not substantially contain rosin.

Even when a toner has a high content of a rosin component, by containing a benzilic acid compound, it is possible to suppress aggregation of respective toner particles, and to stably form a favorable image over a long period of time without deterioration of preservation stability of the toner.

It is preferable that the toner is formed of an admixture of a master batch which contains the polyester resin A, the colorant and the benzilic acid compound, and the polyester resin B.

Further, the technology provides a method of manufacturing a toner comprising:

a mixing step of preparing an admixture by mixing a binder resin, a colorant and a benzilic acid compound, the binder resin containing a polyester resin A obtained by subjecting aromatic dicarboxylic acid, rosin and trivalent or higher-valent alcohol as starting materials to polycondensation, a content of the rosin in a sum of the starting materials being 60% by weight or more, a polyester resin B obtained by subjecting aromatic dicarboxylic acid and polyhydric alcohol as starting materials to polycondensation;

a melt-kneading step of melt-kneading the admixture to prepare a kneaded material;

a cooling and pulverizing step of cooling and solidifying the kneaded material to prepare a pulverized material by means of pulverization; and a classifying step of classifying the pulverized material.

A method of manufacturing a toner comprising a mixing step, a melt-kneading step, a cooling and pulverizing step and a classifying step. At the mixing step, an admixture is prepared by mixing a binder resin, a colorant and a benzilic acid compound, the binder resin containing a polyester resin A which is obtained by subjecting aromatic dicarboxylic acid, rosin and trivalent or higher-valent alcohol as materials to polycondensation, a content of the rosin in the materials being 60% by weight or more, and a polyester resin B obtained by subjecting aromatic dicarboxylic acid and polyhydric alcohol as materials to polycondensation, which polyester resin B does not substantially contain rosin. At the melt-kneading step, an admixture is melt-kneaded to prepare a kneaded material. At the cooling and pulverizing step, the kneaded material is cooled and solidified to prepare a pulverized material by means of pulverization. At the classifying step, the pulverized material is classified.

A benzilic acid compound is used in this manner, thereby improving preservation stability of a toner even in the case of a high content of a rosin component, and it is possible to obtain a toner capable of suppressing aggregation of respective toner particles. An image is formed with use of such a toner so that it is possible to stably form a favorable image over a long period of time.

Further, it is preferable that the mixing step comprises:

preparing a master batch by mixing and kneading the polyester resin A, the colorant and the benzilic acid compound, and preparing the admixture by the polyester resin B and the master batch.

At the mixing step, after the polyester resin A, the colorant and the benzilic acid compound are mixed and kneaded to prepare a master batch, the polyester resin and the master batch are mixed to prepare the admixture. Consequently, it is possible to uniformly disperse the colorant into the binder resin, and to obtain a toner with good charging stability.

Further, it is preferable that the benzilic acid compound is contained in an amount of 1 part by weight or more and 3 parts by weight or less relative to 100 parts by weight of the binder resin.

The benzilic acid compound is contained in an amount of 1 part by weight or more and 3 parts by weight or less relative to 100 parts by weight of the binder resin. When a content of the benzilic acid compound is less than 1 part by weight relative to 100 parts by weight of the binder resin, an effect that an apparent glass transition temperature is increased by allowing a toner to contain the benzilic acid compound is not sufficiently exercised. When the content of the benzilic acid compound exceeds 3 parts by weight relative to 100 parts by weight of the binder resin, there is too much influence on chargeability due to addition of the benzilic acid compound, and charging characteristics are deteriorated to reduce charging stability, so that an image quality of an image to be formed is deteriorated. The content of the benzilic acid compound is 1 part by weight or more and 3 parts by weight or less relative to 100 parts by weight of the binder resin, whereby it is possible to suppress aggregation of respective toner particles as well as maintain good charging stability.

Further, it is preferable that the benzilic acid compound is a boron compound having benzilic acid as ligand.

Since the benzilic acid compound is a boron compound having benzilic acid as ligand, it is possible to stably suppress aggregation of respective toner particles even when a toner has a high content of a rosin component, and it is possible to further stably form a favorable image over a long period of time without deterioration of preservation stability of the toner.

BRIEF DESCRIPTION OF THE DRAWINGS

Other and further objects, features, and advantages of the technology will be more explicit from the following detailed description taken with reference to the drawings wherein:

FIG. 1 is a flowchart showing an example of procedure of a method for manufacturing a toner according to an embodiment.

DETAILED DESCRIPTION

Now referring to the drawings, preferred embodiments are described below.

1. Method for Manufacturing Toner

FIG. 1 is a flowchart showing an example of procedure of a method for manufacturing a toner according to an embodiment. A toner according to the embodiment includes a binder resin and a colorant as main components and is manufactured by the method for manufacturing the toner according to the embodiment. The method for manufacturing the toner according to the embodiment is a method for forming particles by dry process and includes a mixing step S1, a melt-kneading step S2, a cooling and pulverizing step S3, a classifying step S4, and an external addition step S5.

(1) Mixing Step S1

At the mixing step S1, a binder resin, a colorant and a benzilic acid compound are dry-mixed with each other in a mixer to prepare an admixture. At this time, an additive is added as necessary. Examples of the additive include magnetic powder, a release agent, and a charge control agent.

(Binder Resin)

A toner according to the embodiment contains, as a binder resin, a polyester resin A and a polyester resin B. The polyester resin can provide excellent transparency, and imparts excellent powder flowability, low-temperature fixability, second color reproducibility and the like to toner particles, and is therefore suitable for a material for a color toner. The polyester resin A and the polyester resin B are obtained by means of polycondensation of an acid component such as polybasic acid and polyhydric alcohol as starting materials.

The polyester resins A and B according to the embodiment are manufactured by a publicly known polycondensation reaction method. As a reaction method, ester exchange reaction or direct esterification reaction is applicable. Moreover, it is also possible to prompt polycondensation such as by increasing a reaction temperature under pressure, or flowing inactive gases under reduced pressure or normal pressure. In the aforementioned reaction, the reaction may be prompted using a publicly known and common reaction catalyst such as at least one of metal compounds among antimony, titanium, tin, zinc, aluminum, and manganese. The amount of the reaction catalyst added is preferably 0.01 part by weight or more and 1.0 part by weight or less relative to 100 parts by weight of the sum of acid components and polyalcohol.

In preparing the polyester resin A, aromatic dicarboxylic acid and rosin are used as acid components, and trivalent or higher-valent alcohol is used as polyalcohol. With the reaction of the aromatic dicarboxylic acid and the trivalent or higher-valent alcohol, a polyol structure with an appropriate branch is formed. When the polyester resin includes an appropriate branched structure, it is possible to maintain low-temperature fixability of the toner without extremely increasing a softening temperature of the resin as well as to broaden a molecular weight distribution of the resin and to obtain a resin in which a distribution of the high-molecular weight side is broad, so that the toner has an excellent offset resistance.

Examples of the aromatic dicarboxylic acid used for the polyester resin A include phthalic acid, terephthalic acid, isophthalic acid, biphenyldicarboxylic acid, naphthalenedicarboxylic acid, and 5-tert-butyl-1,3-benzenedicarboxylic acid. In addition, as the acid components of the polyester resin A, instead of the aforementioned aromatic dicarboxylic acids, aromatic dicarboxylic acid anhydride or an aromatic dicarboxylic acid derivative such as lower alkyl ester may be used. Among the aforementioned aromatic dicarboxylic acid compounds, at least one of terephthalic acid, isophthalic acid, and lower alkyl esters thereof is preferably used Terephthalic acid and isophthalic acid have a great electron resonance stabilization effect by the aromatic ring skeleton and excellent charging stability, thereby obtaining a resin with appropriate strength. Examples of the lower alkyl ester of terephthalic acid and isophthalic acid include dimethyl terephthalate, dimethyl isophthalate, diethyl terephthalate, diethyl isophthalate, dibutyl terephthalate, and dibutyl isophthalate. Among them, dimethyl terephthalate or dimethyl isophthalate is preferably used from a viewpoint of cost and handling.

These aromatic dicarboxylic acid compounds may be used each alone, or two or more of them may be used in combination.

Examples of the trivalent or higher-valent alcohol used for the polyester resin A include trimethylolethane, trimethylolpropane, glycerin, and pentaerythritol, and at least one of these polyalcohols is usable. Among them, glycerin is more preferable because a technique of manufacturing from a plant-derived material is established industrially so that glycerin is easily available and an effect of prompting the use of biomass is obtained.

A mole ratio of the trivalent or higher-valent alcohol to the aromatic dicarboxylic acid compound in the polyester resin A is preferably 1.05 or more and 1.65 or less. When the mole ratio of the trivalent or higher-valent alcohol to the aromatic dicarboxylic acid compound is less than 1.05, a molecular weight distribution of the high-molecular weight side of the resin is broadened and Tm becomes high to thereby decrease low-temperature fixability of the toner, and it becomes impossible to control broadening of the molecular weight distribution, resulting that gelation of the toner occurs. When the mole ratio exceeds 1.65, the polyester resin has less branched structures and a softening temperature and a glass transition temperature are thus reduced, resulting that preservation stability of the toner is decreased.

The rosin used for the polyester resin A is preferably disproportionated rosin. The disproportionated rosin is obtained by stabilizing rosin which is a natural resin obtained from pine with disproportionation reaction. The rosin contains as main components resin acids such as abietic acid, palustric acid, neoabietic acid, pimaric acid, dehydroabietic acid, isopimaric acid and sandaracopimaric acid, and an admixture thereof, and is classified into toll rosin obtained from a crude toll oil which is a by-product in the production process of pulp, gum rosin obtained from raw turpentine, wood rosin obtained from stumps of pine trees, and the like. These rosins are obtained by a conventionally known method.

The disproportionated rosin is obtained in such a manner that rosin is heated at a high temperature in the presence of noble metal catalyst or halogen catalyst, and is polycondensed cyclic monocarboxylic acid in which an unstable conjugated double bond in a molecule disappears, which has a feature that a material is hard to be converted compared to rosin having a conjugated double bond. The disproportionated rosin contains a mixture of dehydroabietic acid and dihydroabietic acid as main components. Since the disproportionated rosin includes a bulky and rigid skeleton of a hydrophenanthrene ring, by introducing the disproportionate rosin as components of polyester, elevation of an apparent glass transition temperature is promoted compared to the case where rosin except the disproportionated rosin is used, and it is possible to obtain a toner having excellent preservation stability.

As described above, the polyester resin A is obtained by subjecting aromatic dicarboxylic acid, rosin and trivalent or higher-valent alcohol as starting materials to polycondensation. In the embodiment, for obtaining a toner with excellent environmental safety, the rosin content in a sum of the starting materials is 60% by weight or more as the underlying structure of the polyester resin A.

As rosin, disproportionated rosin is preferred. Disproportionated rosin contains a bulky and rigid skeleton of a hydrophenanthrene ring so that crystallization is promoted, and the apparent glass transition temperature is raised by using disproportionated rosin so that it is possible to improve preservation stability of a toner.

It is preferred that a rosin content is 15 parts by weight or more and 45 parts by weight or less relative to 100 parts by weight of a toner. When the rosin content is less than 15 parts by weight, global environment conservation with use of biomass is less effective, and when the rosin content exceeds 45 parts by weight, deterioration of mechanical strength and deterioration of powder flowability in a toner are occurred.

For the polyester resin A, aliphatic polycarboxylic acid or trivalent or higher-valent aromatic polycarboxylic acid is further usable as the acid component other than the aforementioned aromatic dicarboxylic acid compounds and rosin.

Examples of the aliphatic polycarboxylic acid include alkyl dicarboxylic acids such as succinic acid, adipic acid, sebacic acid, and azelaic acid; unsaturated dicarboxylic acids such as succinic acid which is substituted by an alkyl group having a carbon number of 16 to 18, fumaric acid, maleic acid, citraconic acid, itaconic acid, and glutaconic acid; and dimmer acid.

A content of the aliphatic polycarboxylic acid in the polyester resin A is preferably 0.5 mole or more and 15 moles or less, and more preferably 1 mole or more and 13 moles or less relative to 100 moles of an aromatic dicarboxylic acid compound. When the content of the aliphatic polycarboxylic acid in the polyester resin A falls within such a range, low-temperature fixability of the toner is improved.

Examples of the trivalent or higher-valent aromatic polycarboxylic acid include trimellitic acid, pyromellitic acid, naphthalenetricarboxylic acid, benzophenonetetracarboxylic acid, biphenyltetracarboxylic acid, and anhydride thereof. These aromatic polycarboxylic acids may be used each alone, or two or more of them may be used in combination. Among aromatic polycarboxylic acids, trimellitic anhydride is preferably used from a viewpoint of reactivity.

A content of the trivalent or higher-valent aromatic polycarboxylic acid in the polyester resin A is preferably 0.1 mole or more and 5 moles or less, and more preferably 0.5 mole or more to 3 moles or less relative to 100 moles of the aromatic dicarboxylic acid compound. When the content of the trivalent or higher-valent aromatic polycarboxylic acid in the polyester resin A is less than 0.1 mole, the branched structure in the polyester resin A is insufficient and it is impossible to obtain the polyester resin A with broad distribution on a higher molecular weight amount side, so that an offset resistance of the toner may be decreased. Moreover, in the case of exceeding 5 moles, a softening temperature of the polyester resin A becomes high, so that low-temperature fixability of the toner is possibly decreased.

In addition, for the polyester resin A, at least one of aliphatic diol and etherified diphenol is further usable as the polyalcohol other than the trivalent higher-valent alcohol.

Examples of the aliphatic diol include ethylene glycol, 1,2-propanediol, 1,3-propanediol, 1,2-butanediol, 1,3-butanediol, 1,4-butanediol, 2,3-butanediol, 1,4-butenediol, 2-methyl-1,3-propanediol, 1,5-pentanediol, neopentyl glycol, 2-ethyl-2-methylpropane-1,3-diol, 2-butyl-2-ethylpropane-1,3-diol, 1,6-hexanediol, 3-methyl-1,5-pentanediol, 2-ethyl-1,3-hexanediol, 2,4-methyl-1,5-pentanediol, 2,2,4-trimethyl-1,3-pentanediol, 1,7-neptanediol, 1,8-octanediol, 1,9-nonanediol, 1,10-decanediol, 3-hydroxy-2,2-dimethylpropyl-3-hydroxy-2,2-dimethylpropanoate, diethylene glycol, triethylene glycol, and dipropylene glycol. Among these aliphatic diols, ethylene glycol, 1,3-propanediol, or neopentyl glycol is preferably used from a viewpoint of reactivity with acid and a glass transition temperature of the resin. These aliphatic diols may be used each alone, or two or more of them may be used in combination.

Generally, the content of the aliphatic diol in the polyester resin A is preferably 5 moles or more and 20 moles or less relative to 100 moles of the aromatic dicarboxylic acid compound.

The etherified diphenol is diol obtained by subjecting bisphenol A and alkylene oxide to addition reaction. Examples of the alkylene oxide include ethylene oxide and propylene oxide, and the alkylene oxide is preferably added so that the average mole number is 2 moles or more and 16 moles or less relative to 1 mole of the bisphenol A.

Generally, the content of the etherified diphenol in the polyester resin A is preferably 5 moles or more and 35 moles or less relative to 100 moles of the aromatic dicarboxylic acid compound.

In the toner according to the embodiment, the content of the polyester resin A is preferably 20 parts by weight or more and 60 parts by weight or less relative to 100 parts by weight of the toner. When the content of the polyester resin A is less than 20 parts by weight, the viscosity of the toner increases to diminish low-temperature fixability. In addition, when the content of the polyester resin A exceeds 60 parts by weight, the content of the rosin is increased so that the mechanical strength of the toner is decreased or powder flowability is decreased.

The polyester resin B is a polyester resin which substantially does not include rosin, and preferably has high-molecular weight and high viscosity to impart a high-temperature offset resistance to the toner.

As the acid component of the polyester resin B, the aromatic dicarboxylic acid compound similar to that of the polyester resin A is usable. The polyester resin A and the polyester resin B may include the same or different aromatic dicarboxylic acid compound. In addition, for the polyester resin B, as the acid component, aliphatic polycarboxylic acid or trivalent or higher-valent aromatic polycarboxylic acid similar to that of the polyester resin A is further usable other than the aforementioned aromatic dicarboxylic acid compound. The polyester resin A and the polyester resin B may use the same or different acid component.

Moreover, as the acid component of the polyester resin B, polybasic acids such as saturated polybasic acid and unsaturated polybasic acid, acid anhydride thereof, and lower alkyl ester thereof are usable.

Examples of the saturated polybasic acid, the saturated polybasic acid anhydride, and lower alkyl ester thereof include dibasic acids such as adipic acid, sebacic acid, orthophthalic acid, phthalic anhydride, isophthalic acid, terephthalic acid, succinic acid, succinic anhydride, alkyl succinic acid having a carbon number of 8 to 18, alkyl succinic anhydride, alkenyl succinic acid, and alkenyl succinic anhydride; trimellitic acid; trimellitic anhydride; cyanuric acid; pyromellitic acid; and pyromellitic anhydride.

Examples of the unsaturated polybasic acid include maleic acid, maleic anhydride, and fumaric acid.

Saturated polybasic acid and unsaturated polybasic acid may be used each alone, or two or more of them may be used in combination. In addition, monobasic acid such as benzoic acid and p-tert-butyl benzoic acid may be used as necessary.

As the polyalcohol of the polyester resin B, trivalent or higher-valent alcohol, aliphatic diol, and etherified diphenol are usable similarly to those of the polyester resin A, and the polyester resin. B may use the same or different polyalcohol as or from that of the polyester resin A. Moreover, alicyclic dials such as cyclohexanedimethanol may be used. The polyalcohols may be used each alone, or two or more of them may be used in combination. Further, monoalcohols such as stearyl alcohol may be used as necessary to an extent that the effect of the technology is not impaired. Further, monoalcohols such as stearyl alcohol may be used as necessary to an extent that the effect of the present technology is not impaired.

A viscosity of the polyester resin B is $10^3$ Pa·s or more and $10^5$ Pa·s or less at a softening temperature of the polyester resin A. When the viscosity of the polyester resin B at the softening temperature of the polyester resin A is less than $10^3$ Pa·s, a hot-offset resistance of a toner cannot be obtained. Moreover, when the viscosity of the polyester resin B at the softening temperature of the polyester resin A exceeds $10^5$ Pa·s, there is great difference of melt viscosity between the polyester resin A and the polyester resin B at the time of kneading, and mixability of resins becomes worse, so that the polyester resin A and the polyester resin B in the toner come to have uneven dispersibility. In a toner particle, a part with a high rate of the presence of the polyester resin A is easily broken, and such breakage causes occurrence of fine powder with a small particle size. With such fine powder, particle size distribution and charging distribution are broadened, resulting that failure such as an image fog is caused.

The glass transition temperature of the polyester resin A and the polyester resin B is not particularly limited and may be selected appropriately from a wide range, and taking into account preservation stability, low-temperature fixability and the like of the obtained toner, the glass transition temperature is preferably 45° C. or higher and 80° C. or lower, and more preferably 50° C. or higher and 65° C. or lower. When the glass transition temperature of the polyester resin A and the polyester resin B is lower than 45° C., the preservation stability of the toner is insufficient so that thermal aggregation of the toner inside an image forming apparatus is easy to occur, thus generating development failure. Moreover, a temperature at which the generation of hot offset starts (hereinafter, referred to as "hot offset initiation temperature") is lowered.

The "hot offset" refers to a phenomenon in which in fixing a toner onto a recording medium by heating and applying a pressure with a fixing member, an aggregation power of heated toner particles is lower than an adhesion strength between the toner and the fixing member, so that the toner layer is divided, and a part of the toner attaches to the fixing member and is removed away. Additionally, when the glass transition temperature of the polyester resins A and B exceeds 80° C., low-temperature fixability of the toner is decreased, thereby generating fixation failure.

For the binder resin, as long as it is possible to achieve the object of the technology, resins which are conventionally used as the binder resin for a toner, including a polystyrene-based polymer, a polystyrene-based copolymer such as a styrene-acryl-based resin, and polyester resins other than the aforementioned polyester resins, may be used with the aforementioned polyester resins.

(Colorant)

As a colorant included in the toner according to the embodiment, those which are commonly used in the electrophotographic field such as an organic dye, an organic pigment, an inorganic dye, and an inorganic pigment are usable. Among a dye and a pigment, a pigment is preferably used. Since a pigment is more excellent in light resistance and coloring properties than a dye, the use of a pigment makes it possible to obtain a toner having excellent light resistance and coloring properties.

Examples of a yellow colorant include organic pigments such as C.I. Pigment Yellow 1, C.I. Pigment Yellow 5, C.I. Pigment Yellow 12, C.I. Pigment Yellow 15, C.I. Pigment Yellow 17, C.I. Pigment Yellow 74, C.I. Pigment Yellow 93, C.I. Pigment Yellow 180, and C.I. Pigment Yellow 185; inorganic pigments such as yellow iron oxide and yellow ocher; nitro-based dyes such as C.I. Acid Yellow 1; and oil-soluble dyes such as C.I. Solvent Yellow 2, C.I. Solvent Yellow 6, C.I. Solvent Yellow 14, C.I. Solvent Yellow 15, C.I. Solvent Yellow 19, and C.I. Solvent Yellow 21, which are all classified according to color index.

Examples of a red colorant include C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10, and C.I. Disperse Red 15, which are all classified according to color index.

Examples of a blue colorant include C.I. Pigment Blue 15, C.I. Pigment Blue 16, C.I. Solvent Blue 55, Solvent Blue 70, C.I. Direct Blue 25, and C.I. Direct Blue 86, which are all classified according to color index, and KET. BLUE 111.

Examples of a black colorant include carbon black such as channel black, roller black, disk black, gas furnace black, oil furnace black, thermal black, and acetylene black.

Other than these colorants, a bright red pigment, a green pigment, and the like are usable. These colorants may be used each alone, or two or more of them may be used in combination. Further, it is possible to use two or more of the colorants of the same color series and also possible to use one or two or more of the colorants respectively from different color series.

The colorant is preferably used in form of a master batch in order to be dispersed uniformly into the polyester resin. In the embodiment, the master batch can be manufactured, for example, by dry-mixing the polyester resin A and the colorant in a mixer and kneading the obtained powder admixture by a kneader. A kneading temperature depends on the softening temperature of the polyester resin A and is generally about 50 to 150° C. and preferably about 50 to 120° C.

For the mixer for dry-mixing master batch materials, publicly known mixers are usable and examples thereof include a Henschel-type mixing device such as HENSCHEL MIXER (trade name, manufactured by Mitsui Mining Co., Ltd.), SUPERMIXER (trade name, manufactured by Kawata MFG Co., Ltd.), and MECHANOMILL (trade name, manufactured by Okada Seiko Co., Ltd.); ANGMILL (trade name, manufactured by Hosokawa Micron Corporation); HYBRIDIZATION SYSTEM (trade name, manufactured by Nara Machinery Co., Ltd.); and COSMOSYSTEM (trade name, manufactured by Kawasaki Heavy Industries, Ltd.) Also for the kneader, publicly known kneaders are usable and, for example, general kneaders such as a kneader, a twin-screw extruder, a two-roller mill, a three-roller mill, and a laboplast mill are usable. More specifically, examples thereof include single-screw or twin-screw extruders such as TEM-100B (trade name, manufactured by Toshiba Machine Co., Ltd.), and PCM-65/87 or PCM-30 (all of which are a trade name, manufactured by Ikegai Corp), and open roll type kneaders such as KNEADEX (trade name, manufactured by Mitsui Mining Co., Ltd.) Melt-kneading may be performed with the use of a plurality of kneaders.

The obtained master batch is, for example, pulverized into a particle size of from about 2 mm to 3 mm and then used.

As the concentration of the colorant in the toner, the concentration of the black colorant such as carbon black is preferably 5% by weight or more and 12% by weight or less, and more preferably 6% by weight or more and 8% by weight or less. The concentration of the colorant other than black is preferably 3% by weight or more and 8% by weight or less, and more preferably 4% by weight or more and 6% by weight or less. When the master batch is used, it is preferred to adjust the used amount of the master batch so that the concentration of the colorant in the toner falls within such a range. When the concentration of the colorant falls within such a range, it is possible to obtain a toner that suppresses the filler effect caused by addition of the colorant and has high color appearance and is also possible to form a good image having sufficient image density, a high coloring property and favorable image quality.

(Benzilic Acid Compound)

As a benzilic acid compound contained in the toner according to the embodiment, a compound having a skeleton of benzilic acid (diphenylhydroxyacetic acid) in a molecule is usable, and for example, benzilic acid, and a complex with benzilic acid as ligand (trade name: LR-147, manufactured by Japan Carlit Co., Ltd.) and the like are included.

It is possible to suppress aggregation of respective toner particles by containing a benzilic acid compound even in the case of a toner with a high content of a rosin component, and preservation stability of the toner is thus not deteriorated so that it is possible to stably form a favorable image over a long period of time.

It is assumed that the reason is caused by which the benzilic acid compound is added at this step, and at the melt-kneading step S2 which will be described below, the benzilic acid compound is melt-kneaded together with the polyester resin A with a high content of a rosin component and the polyester resin B, whereby a temperature of an endothermic peak when a toner is heated and melted is raised so that an apparent glass transition temperature of the toner is raised.

Note that, the endothermic peak indicates a state change of a substance capable of measuring with a differential scanning calorimeter (DSC) or the like, and the endothermic peak here supposedly corresponds to a change to a rubber state that is an intermediate state between a solid state and a liquid state. It is not known exactly why a temperature of the endothermic peak is raised, which reason is however assumed that partial crystallization of the rosin component as the starting material of the polyester resin A, by containing the benzilic acid compound, is promoted in cooling process after melting and kneading when a toner is prepared, and the apparent glass transition temperature of the toner at the time of melting and kneading is raised.

The benzilic acid compound is preferably a boron compound having benzilic acid as ligand it is assumed that because of a good combination of conformation of the boron compound having benzilic acid as ligand and a rosin skeleton contained in the polyester resin A, the benzilic acid compound is the boron compound having benzilic acid as ligand, whereby partial crystallization of the rosin compound is further promoted, so that it is possible to further raise the apparent glass transition temperature of the toner.

A content of the benzilic acid compound is preferably 1 part by weight or more and 3 parts by weight or less relative to 100 parts by weight of the binder resin. When the content of the benzilic acid compound is less than 1 part by weight relative to 100 parts by weight of the binder resin, a suppression effect against lowering of a glass transition temperature due to containing of the benzilic acid compound is not sufficiently exercised. When the content of the benzilic acid compound exceeds 3 parts by weight relative to 100 parts by weight of the binder resin, there is too much influence on chargeability due to addition of the benzilic acid compound. Therefore, charging characteristics are deteriorated so that charging stability is reduced, and a quality of an image to be formed is deteriorated. When the content of the benzilic acid compound is 1 part by weight or more and 3 parts by weight or less relative to 100 parts by weight of the binder resin, it is possible to stably suppress aggregation of respective toner particles as well as provide good charging stability.

The benzilic acid compound is preferably a boron compound having benzilic acid as ligand.

(Magnetic Powder)

Examples of the magnetic powder included in the toner according to the embodiment include magnetite, y hematite, and various kinds of ferrite.

(Release Agent)

As the release agent included in the toner according to the embodiment, those which are commonly used in this field are usable and an example thereof includes a wax. Examples of the wax include natural waxes such as a paraffin wax, a carnauba wax, and a rice wax; synthetic waxes such as a polypropylene wax, a polyethylene wax, and a Fischer-Tropsch wax; coal based waxes such as a montan wax; petroleum based waxes; alcohol based waxes; and ester based waxes.

The release agents may be used each alone, or two or more of them may be used in combination. The amount of the release agent added is not particularly limited and may be selected appropriately from a wide range depending upon various conditions such as the kinds and contents of other components including the binder resin and the colorant or properties which are required for the toner to be prepared, and is preferably 3 parts by weight or more and 10 parts by weight or less relative to 100 parts by weight of the binder resin. When the amount of the release agent added is less than 3 parts by weight, low-temperature fixability and a hot-offset resistance are not sufficiently improved. When the amount of the release agent added exceeds 10 parts by weight, dispersibility of the release agent in the kneaded material is lowered, and thus, it is impossible to stably obtain a toner having a fixed performance. Moreover, a phenomenon called filming, in which the toner is fused in a coating (film) form on the surface of an image bearing member such as a photoreceptor, is generated.

A melting point (Tm) of the release agent is preferably 50° C. or higher and 180° C. or lower. When the melting point is lower than 50° C., the release agent is melted inside a developing device and toner particles are aggregated to each other or the filming on a surface of a photoreceptor or the like is generated. When the melting point exceeds 180° C., the release agent cannot sufficiently elute when the toner is fixed to a recording medium, so that the hot-offset resistance is not sufficiently improved.

(Charge Control Agent)

As the charge control agent included in the toner according to the embodiment, charge control agents for positive charge control and negative charge control which are commonly used in this field are usable.

Examples of the charge control agent for positive charge control include a basic dye, quaternary ammonium salt, quaternary phosphonium salt, aminopyrine, a pyrimidine compound, a polynuclear polyamino compound, aminosilane, a nigrosine dye and a derivative thereof, a triphenylmethane derivative, guanidine salt, and amidine salt.

Examples of the charge control agent for negative charge control can include chrome azo complex dye; iron azo complex dye; cobalt azo complex dye; chromium complex, zinc complex, aluminum complex and boron complex of salicylic acid or derivative thereof; a salicylate compound; chromium complex, zinc complex, aluminum complex and boron complex of naphthol acid and derivative thereof; a naphthol acid salt compound; a benzilic acid salt compound; and surfactant such as long-chain alkyl carboxylate and long-chain alkyl sulfonate.

The amount of the charge control agent added is preferably 0.01 part by weight or more and 5 parts by weight or less relative to 100 parts by weight of the binder resin.

For the mixer used at the mixing step S1, those which are publicly known are usable, and examples thereof include a Henschel-type mixing device such as HENSCHEL MIXER (trade name, manufactured by Mitsui Mining Co., Ltd.), SUPERMIXER (trade name, manufactured by Kawata MFG Co., Ltd.), and MECHANOMILL (Trade name, manufactured by Okada Seiko Co., Ltd.); and ANGMILL (trade name, manufactured by Hosokawa Micron Corporation); HYBRIDIZATION SYSTEM (trade name, manufactured by Nara Machinery Co., Ltd.); and COSMOSYSTEM (trade name, manufactured by Kawasaki Heavy Industries Ltd.)

(2) Melt-Kneading Step S2

At the melt-kneading step S2, the admixture prepared at the mixing step is melt-kneaded with a kneader to prepare a melt-kneaded material in which a colorant, a benzilic acid compound and an additive added as necessary are dispersed into a binder resin.

For the kneader used at the melt-kneading step, those which are publicly known are usable and the kneaders same as those which are used for preparing the master batch are usable. Melt-kneading may be performed with the use of a plurality of kneaders.

The temperature of melt-kneading depends upon the kneader that is used and is preferably 80° C. or higher and 200° C. or lower. Melt-kneading under the temperature in such a range makes it possible to uniformly disperse the colorant and the additive added as necessary into the binder resin.

(3) Cooling and Pulverizing Step S3

At the cooling and pulverizing step S3, the melt-kneaded material obtained at the melt-kneading step S2 is cooled, solidified, and pulverized to obtain a pulverized material.

The melt-kneaded material which has been cooled and solidified is coarsely pulverized into a coarsely pulverized material having a volume average particle size of 100 μm or more and 5 mm or less by a hammer mill, a cutting mill or the like, and the obtained coarsely pulverized material is further finely pulverized, for example, to have a volume average particle size of 15 μm or less. For fine pulverization of the coarsely pulverized material, for example, a jet pulverizer utilizing an ultrasonic jet stream, an impact pulverizer for achieving pulverization by introducing a coarsely pulverized material into a space to be formed between a rotator (rotor) rotating at a high speed and a stator (liner), or the like is usable.

(4) Classifying Step S4

At the classifying step S4, the pulverized material obtained at the cooling and pulverizing step S3 is classified by a classifier and an excessively-pulverized toner particle and a coarse toner particle are removed therefrom to obtain a toner having no external additives. The excessively-pulverized toner particle and the coarse toner particle can be also recovered and reused for manufacturing other toner.

For the classification, publicly known classifiers capable of removing excessively pulverized toner particles by classification with a centrifugal force and classification with a wind force are usable and, for example, a revolving type wind-force classifier (rotary type wind-force classifier) and the like are usable.

The toner having no external additives obtained after the classification preferably has a volume average particle size of 3 μm or more and 15 μm or less. For the purpose of obtaining an image with high image quality, the toner having no external additives preferably has a volume average particle size of 3 μm or more and 9 μm or less, and more preferably 5 μm or more and 8 μm or less. When the volume average particle size of the toner having no external additives is less than 3 μm, the particle size of the toner becomes small so that high electrification and low fluidization occur. With high electrification and low fluidization of the toner, the toner is not stably supplied into a photoreceptor, and thus, background fogging, a reduction of the image density, and the like are generated. When the volume average particle size of the toner having no external additives exceeds 15 μm, the particle size of the toner is too large to obtain an image with high resolution. In addition, as the particle size of the toner is large, a specific surface area is decreased, and the charge amount of the toner becomes low. As a result, the toner is not stably supplied into the photoreceptor, and thus, contamination within the machine is generated due to flying of the toner.

(5) External Addition Step S5

At the external addition step S5, the toner having no external additives obtained at the classifying step S4 and the external additive are mixed to obtain a toner. By adding the external additive, flowability of the toner and a cleaning property of the toner remaining on the surface of a photoreceptor are improved, thus making it possible to prevent the filming on the photoreceptor. It is also possible to use a toner having no external additives to which no external additives are added as the toner.

Examples of the external additive include inorganic oxides such as silica, alumina, titanic, zirconia, tin oxide, and zinc oxide; compounds such as acrylic acid esters, methacrylic acid esters, and styrene, or copolymer resin fine particles of those compounds; fluorine resin fine particles; silicone resin fine particles; higher fatty acids such as stearic acid, or metallic salts of those higher fatty acids; carbon black; graphite fluoride; silicon carbide; and boron nitride.

The external additive is preferably subjected to the surface treatment by a silicone resin, a silane coupling agent, or the like. In addition, the amount of the external additive added is preferably 0.5 part by weight or more and 5 parts by weight or less relative to 100 parts by weight of the binder resin.

A number average particle size of primary particles of the external additive is preferably 10 nm or more and 500 nm or less. When the number average particle size of primary particles of the external additive falls within such a range, flowability of the toner is further improved.

A BET specific surface area of the external additive is preferably 20 $m^2/g$ or more and 200 $m^2/g$ or less. When the BET specific surface area of the external additive falls within such a range, it is possible to impart appropriate flowability and chargeability to the toner.

2. Toner

The toner according to the embodiment is manufactured by the method of manufacturing the toner which is the aforementioned embodiment. The toner obtained by the method of manufacturing the toner is sufficient in mechanical strength, excellent in a hot-offset resistance and charging stability.

3. Developer

The toner according to the embodiment is usable as a one-component developer composed of a toner alone or is also usable as a two-component developer upon being mixed with a carrier.

As the carrier, those which are publicly known are usable and examples thereof include single or complex ferrite composed of iron, copper, zinc, nickel, cobalt, manganese, chromium, or the like; a resin-coated carrier having carrier core particles whose surfaces are coated with coating materials; and a resin-dispersion type carrier in which magnetic particles are dispersed in a resin.

As the coating material, those which are publicly known are usable, and examples thereof include polytetrafluoroethylene, a monochlorotrifluoroethylene polymer, polyvinylidene fluoride, a silicone resin, a polyester resin, a metal compound of di-tertiary-butylsalicylic acid, a styrene resin, an acrylic resin, polyamide, polyvinyl butyral, nigrosine, an aminoacrylate resin, basic dyes, lakes of basic dyes, fine silica powders, and fine alumina powders.

In addition, the resin used for the resin-dispersion type carrier is not particularly limited, and examples thereof include a styrene-acrylic resin, a polyester resin, a fluorine resin, and a phenol resin. Both of the coating materials are preferably selected according to the toner components, and these may be used each alone, or two or more of them may be used in combination.

The carrier preferably has a spherical shape or a flattened shape. The particle size of the carrier is not particularly limited, and in consideration of forming higher-quality images, the particle size of the carrier is preferably 10 μm to 100 μm, and more preferably 20 μm or more and 50 μm or less. When the particle size of the carrier is 50 μm or less, the toner and the carrier come into contact with each other more frequently, and each toner particle can be charged and controlled properly, thereby allowing for formation of a high-quality images having no fog occurring on the non-image region.

Furthermore, volume resistivity of the carrier is preferably $10^8$ Ω·cm or more, and more preferably $10^{12}$ Ω·cm or more. The volume resistivity of the carrier is a value obtained from a current value determined as follows. The carrier particles are put into a container having a cross-sectional area of 0.50 $cm^2$, and then tapped. Subsequently, a load of 1 $kg/cm^2$ is applied by use of a weight to the particles which are held in the container. When an electric field of 1000 V/cm is generated between the weight and a bottom electrode of the container by application of voltage, a current value is read. When the resistivity of the carrier is low, an electric charge will be injected into the carrier upon application of bias voltage to a developing sleeve, thus causing the carrier particles to be more easily attached to the photoreceptor. Further, breakdown of the bias voltage is more liable to occur.

The magnetization intensity (maximum magnetization) of the carrier is preferably 10 emu/g to 60 emu/g, and more preferably 15 emu/g to 40 emu/g. Under the condition of the ordinary magnetic flux density of the developing roller, a magnetic binding force does not work at a magnetization intensity of less than 10 emu/g, which may cause the carrier to spatter. Further, the carrier having a magnetization intensity of more than 60 emu/g has bushes which are too large to keep the non-contact state of the image bearing member with the toner in the non-contact development and possibly causes sweeping streaks to easily appear on a toner image in the contact development.

The use ratio of the toner to the carrier in the two-component developer is not particularly limited, and is appropriately selected according to kinds of the toner and the carrier. Further, the coverage of the carrier with the toner is preferably 40% or more and 80% or less.

EXAMPLES

Hereinafter, referring to Examples and Comparative Examples, the technology will be specifically described.

Each physicality value in Examples and Comparative Examples was measured as follows.

[Glass Transition Temperature (Tg) of Polyester Resin]

Using a differential scanning calorimeter (trade name: Diamond DSC, manufactured by PerkinElmer Japan Co., Ltd.), 0.01 g of a sample was heated at a temperature rise rate of 10° C. per minute (10° C./min) in conformity with Japan Industrial Standards (JIS) K7121-1987, thereby measuring a DSC curve. A temperature at an intersection between an extended straight line obtained by drawing a base line on a low-temperature side of an endothermic peak corresponding to glass transition of the obtained DSC curve toward a high-temperature side and a tangent line drawn at a point where a gradient became the maximum against the curve on the low-temperature side of the endothermic peak was determined as the glass transition temperature (Tg).

[Softening Temperature (Tm) of Polyester Resin]

Using a device for evaluating flow characteristics (trade name: FLOW TESTER CFT-500C, manufactured by Shimadzu Corporation), 1 g of a sample was heated at a temperature rise rate of 6° C. per minute while applying a load of 10 $kgf/cm^2$ ($9.8\times10^5$ Pa) so as to be pushed out of a die (1 mm in a nozzle aperture and 1 mm in length), and a temperature of the sample at the time when a half of the sample had flowed out of the die was determined as the softening temperature (Tm).

[Weight Average Molecular Weight (Mw) and Number Average Molecular Weight (Mn) of Polyester Resin]

A sample was dissolved in a tetrahydrofuran (THF) to be 0.25% by weight, and 200 μL of the sample was injected to a GPC device (trade name: HLC-8220GPC, manufactured by Tosoh Corporation) and a molecular weight distribution curve was determined at a temperature of 40° C.

A weight average molecular weight Mw and a number average molecular weight Mn were determined from the obtained molecular weight distribution curve, and a molecular weight distribution index (Mw/Mn; hereinafter also referred to simply as "Mw/Mn") which is a ratio of the weight average molecular weight Mw to the number average molecular weight Mn was determined. Note that, a molecular weight calibration curve was made using standard polystyrene.

[Acid Value of Polyester Resin and Rosin]

An acid value was measured by a neutralization titration method. In 50 mL of tetrahydrofuran (THF), 5 g of a sample was dissolved, and after adding a few drops of an ethanol solution of phenolphthalein as an indicator, the solution was titrated with 0.1 mole/L of a potassium hydroxide (KOH) aqueous solution. A point at which a color of the sample solution changed from colorless to purple was defined as an end point, and an acid value (mgKOH/g) was calculated from the amount of the potassium hydroxide aqueous solution required for the arrival at the end point and a weight of the sample provided for the titration.

[THF Insoluble Component of Polyester Resin]

In cylindrical filter paper, 1 g of a sample was inputted and applied to a Soxhlet extractor. Using 100 ml of tetrahydrofuran (THF) as an extraction solvent, reflux was made for 6 hours upon heating, thereby extracting a THF soluble component from the sample. After removing the solvent from an extraction containing the extracted THF soluble component, the THF soluble component was dried at 100° C. for 24 hours, and the obtained THF soluble component was weighed to determine the weight X (g). A proportion P (% by weight) of a THF insoluble component in the sample was calculated from the weight X (g) of the THF soluble component and the weight (1 g) of the sample used for the measurement on the basis of the following expression. This proportion P is hereinafter referred to as THF insoluble component.

$$P(\%\text{ by weight})=\{1(g)-X(g)\}/1(g)\times100 \quad (1)$$

[Melting Point of Release Agent]

Using a differential scanning calorimeter (trade name: Diamond DSC, manufactured by PerkinElmer Japan Co., Ltd.), the temperature of 0.01 g of a sample was heated from 20° C. to 200° C. at a temperature rise rate of 10° C. per minute, subsequently rapidly cooled from 200° C. to 20° C., and this operation was repeated twice to measure a DSC curve. The temperature at the endothermic peak corresponding to melting of the DSC curve measured at the second operation was determined as the melting point of the release agent.

[Volume Average Particle Size and Coefficient Variation of Toner]

To 50 ml of electrolyte (trade name: ISOTON-II, manufactured by Beckman Coulter, Inc.), 20 mg of a sample and 1 ml of sodium alkylether sulfate ester (dispersant, manufactured by Kishida Chemical Co., Ltd.) were added, followed by dispersion processing for 3 minutes at a frequency of 20 kHz with the use of an ultrasonic disperser (trade name: UH-50, manufactured by SMT Corporation), thereby preparing a sample for measurement.

For the sample for measurement, a particle size distribution measuring apparatus (trade name: Multisizer 3, manufactured by Beckman Coulter, Inc.) was used to perform measurement under the conditions where an aperture diameter was 20 μm and the number of particles measured was 50000 counts, thereby determining a volume average particle size from a volume particle size distribution of a sample particle. In addition, the coefficient of variation of the toner was calculated by the following expression on the basis of the volume average particle size and its standard deviation.

$$\text{Coefficient of Variation } CV\,(\%) = (\text{Standard deviation in volume particle distribution}/\text{Volume average particle size}) \times 100 \quad (2)$$

Example 1

Preparation of Polyester Resin A1

In a reaction vessel equipped with an agitating device, a heating device, a thermometer, a cooling pipe, a fractionator and a nitrogen-inducing pipe, 305 g of terephthalic acid, 55 g of isophthalic acid, 30 g of trimellitic anhydride and 1400 g of disproportionated rosin (acid value was 157.2 mgKOH/g), which will serve as acid components; 300 g of glycerin and 150 g of 1,3-propanediol, which will serve as alcoholic components; and 1.79 g of tetra-n-butyltitanate (corresponding to 0.080 part by weight relative to 100 parts by weight of the sum of acid components and alcoholic components) which will serve as reactive catalyst were inputted. These materials were agitated in a nitrogen atmosphere and subjected to the polycondensation reaction for 10 hours at 250° C. while distilling generated water, and after checking the predetermined softening temperature was reached by a flow tester, the reaction was completed, thus a polyester resin A1 (glass transition temperature of 60° C., softening temperature of 112° C., weight average molecular weight of 2800, Mw/Mn=2.3, acid value of 24 mgKOH/g) was obtained.

Preparation of Polyester Resin B

In a reaction vessel equipped with an agitating device, a heating device, a thermometer, a cooling pipe, a fractional distillation device, and a nitrogen-inducing pipe, 350 g of terephthalic acid, 400 g of isophthalic acid, and 50 g of trimellitic anhydride, which will serve as acid components; 125 g of glycerin, 350 g of bisphenol A PO 2 moles adduct, and 450 g of bisphenol A PO 3 moles adduct, which will serve as alcoholic components; 1.38 g of tetra-n-butyl titanate which will server as reaction catalyst were inputted. These materials were agitated in a nitrogen atmosphere and subjected to the polycondensation reaction for 10 hours at 220° C. while distilling generated water, then, were reacted under a reduced pressure of 5 to 20 mmHg (665 to 2660 Pa), and after checking the predetermined softening temperature was reached by a flow tester, the reaction was completed, thus a polyester resin B1 (glass transition temperature of 61° C., softening temperature of 147° C., weight average molecular weight of 29500, Mw/Mn=10.8, acid value of 22 mgKOH/g, THF insoluble component of 40%) was obtained.

<Mixing Step S1>

A master batch in which a carbon black (trade name: MA-77, manufactured by Mitsubishi Chemical Corporation) was dispersed by kneading in advance at the concentration of 11.5% by weight into the polyester resin A1 was prepared. In the obtained master batch, the concentration of carbon black is 11.2% by weight, and concentration of the benzilic acid compound A is 2.9% by weight. An additive amount of the benzilic acid compound A used for preparation of the master batch is 1.3 parts by weight.

Master batch 44.7 parts by weight (22.35 kg)

Polyester resin B 52.7 parts by weight (26.35 kg)

Release agent (polyethylene wax, trade name; Licowax PE-130 Powder, manufactured by Clariant, melting point: 127° C.) 2.6 parts by weight (1.3 kg)

Note that, a content of carbon black in 44.7 parts by weight of the master batch is 5 parts by weight.

The aforementioned materials were mixed for 10 minutes by a Henschel mixer (trade name: FM20C, manufactured by Mitsui Mining Co., Ltd.) and 50 kg of an admixture was obtained.

<Melt-Kneading Step S2>

The admixture obtained at the mixing step S1 was melt-kneaded with a kneader (trade name: twin-screw kneader PCM-60, manufactured by Ikegai Corp) at 80° C. to 120° C. (maximum temperature: 120° C.) of a cylinder setting temperature, the number of rotations of 250 rpm, and supplying rate of 5 kg/h, and the melt-kneaded material was obtained.

<Cooling and Pulverizing Step S3>

The melt-kneaded material obtained at the melt-kneading step S2 was cooled to a room temperature and solidified, then coarsely pulverized by a cutter mill (trade name: VM-16, manufactured by Orient Co., Ltd.). Subsequently, the coarsely pulverized material thus obtained was finely pulverized by a counter jet mill (trade name: AFG, manufactured by Hosokawa Micron Corporation).

<Classifying Step S4>

The pulverized material obtained at the cooling and pulverizing step S3 was classified by a rotary classifier (trade name: TSP separator, manufactured by Hosokawa Micron Corporation), thus a toner having no external additives was obtained.

<External Addition Step S5>

To 100 parts by weight (500 g) of the toner having no external additives obtained at the classifying step S4, 1.2 parts by weight (6 g) of a hydrophobic silica fine particle A (BET specific surface area of 140 $m^2/g$) that was subjected to surface treatment with a silane coupling agent and dimethyl silicone oil, 0.8 part by weight (4 g) of a hydrophobic silica fine particle B (BET specific surface area of 30 $m^2/g$) that was subjected to surface treatment with a silane coupling agent, and 0.5 part by weight (2.5 g) of titanium oxide (BET specific surface area of 130 $m^2/g$) were added and mixed in a Henschel mixer (trade name: FM mixer, manufactured by Mitsui Mining Co., Ltd.), thus a toner of Example 1 (volume average particle size of 6.7 μm, CV value of 25%) was obtained.

Example 2

Preparation of Polyester Resin A2

A polyester resin A2 (glass transition temperature of 55° C., softening temperature of 111° C., weight average molecular weight of 2520, Mw/Mn of 1.9, acid value of 11 mgKOH/g) was obtained in the same manner as in the preparing method of the polyester resin A1, except that terephthalic acid and trimellitic acid anhydride were not used as acid components, the amount of isophthalic acid added was changed to 335 g, the amount of disproportionated rosin added (acid value of 157.2 mgKOH/g) was changed to 1530 g, and only 280 g of glycerin was used as alcohol components.

A toner of Example 2 (volume average particle size of 6.7 μm, CV value of 25%) was obtained in the same manner as in Example 1, except that the polyester resin A2 was used instead of the polyester resin A1 at the mixing step S1.

Example 3

A toner of Example 3 (volume average particle size of 6.7 μm, CV value of 25%) was obtained in the same manner as in Example 1, except that the amount of the benzilic acid compound A added was changed to 0.9 part by weight to prepare a master batch.

Example 4

A toner of Example 4 (volume average particle size of 6.7 μm, CV value of 24%) was obtained in the same manner as Example 1, except that the amount of the benzilic acid compound A added was changed to 2.6 parts by weight to prepare a master batch.

Example 5

A toner of Example 5 (volume average particle size of 6.7 μm, CV value of 25%) was obtained in the same manner as in Example 1, except that the amount of the benzilic acid compound A added was changed to 0.8 part by weight to prepare a master batch.

Example 6

A toner of Example 6 (volume average particle size of 6.7 μm, CV value of 24%) was obtained in the same manner as in Example 1, except that the amount of the benzilic acid compound A added was changed to 2.7 parts by weight to prepare a master batch.

Example 7

A toner of Example 7 (volume average particle size of 6.7 μm, CV value of 25%) was obtained in the same manner as in Example 1, except that a benzilic acid compound B (trade name: benzilic acid, manufactured by Sagami Chemical Industry Co., Ltd.) was used in place of the benzilic acid compound A, and 1.3 parts by weight of a charge control agent (trade name: Copy Charge N4P VP 2481, manufactured by Clariant (Japan) K.K.) was further added when materials of the toner were mixed.

Example 8

A toner of Example 8 (volume average particle size of 6.7 μm, CV value of 25%) was obtained in the same manner as in Example 1, except that a master batch was not prepared at the mixing step S1.

The mixing step S1 was specifically performed as follows.

| | |
|---|---|
| Polyester resin A1 | 38.5 parts by weight |
| Carbon black (trade name: MA-77, manufactured by Mitsubishi Chemical Corporation) | 5.0 parts by weight |
| Polyester resin B1 | 52.7 parts by weight |
| Release agent (polyethylene wax, trade name: Licowax PE-130 Powder, manufactured by Clariant, melting point: 127° C.) | 2.6 parts by weight |
| Benzilic acid compound A (trade name: LR-147, manufactured by Japan Carlit Co., Ltd.) | 1.3 parts by weight |

Such materials were mixed for 10 minutes in a Henschel mixer (trade name: FM20C, manufactured by Mitsui Mining Co., Ltd.) to obtain an admixture.

Comparative Example 1

A toner of Comparative Example 1 (volume average particle size of 6.7 μm, CV value of 25%) was obtained in the same manner as in Example 1, except that the benzilic acid compound A was not used.

Comparative Example 2

A toner of Comparative Example 2 (volume average particle size of 6.7 μm, CV value of 25%) was obtained in the same manner as in Example 1, except that a charge control agent (trade name: BONTRON E-84, manufactured by Orient Chemical Industries Co., Ltd.) was used instead of the benzilic acid compound A. The charge control agent used in Comparative Example 2 is a salicylic acid compound.

The following evaluations were made with use of the toners of Examples 1 to 8 and Comparative Examples 1 and 2.

<Preservation Stability>

Preservation stability was evaluated by means of a mesh-up ratio. In a polyethylene container 100 g of a toner was put to be sealed, and left for 48 hours in a thermostat bath at 50° C. The toner after having been left was vibrated with a vibrating sieving machine equipped with a 200-mesh net at 60 Hz for 1 minute, and weight of the toner remained on the mesh net was measured. A ratio of the toner remained on the mesh net was served as the mesh-up ratio, and the mesh-up ratio was calculated based on the following expression (3). The lower mesh-up rate indicates the better preservation stability of the toner under a high temperature environment.

$$\text{Mesh-up ratio (\%)} = \{\text{Weight of the toner remained on the mesh net (g)}/100\text{ (g)}\} \times 100 \quad (3)$$

Evaluation standards of preservation stability are as follows.

Good: Favorable. The mesh-up ratio is less than 10%.

Not bad: No problem with practical use. The mesh-up ratio is 10% or more and less than 30%.

Poor: No good. The mesh-up ratio is 30% or more.

<Charging Stability>

For the toners of Examples 1 to 8 and Comparative Examples 1 and 2, 5 parts by weight of each toner and 95 parts by weight of a ferrite core carrier (volume average particle size of 70 μm) were mixed for 20 minutes with a V-type mixer (trade name: V-5, manufactured by Tokuju Corporation) to prepare a two-component developer.

A color multi-functional peripheral (trade name: MX-2700, manufactured by Sharp Corporation) was filled with the obtained two-component developer, and performance evaluation was performed under the circumstance at 25° C. and 45% RH with use of a recording sheet (trade name: PPC paper SH-4AM3, manufactured by Sharp Corporation) as a recording medium. As to each item of a charge amount ratio, image density and fog density, a numerical value before printing was compared to a numerical value after 20000 sheets of an original with 5% of an image area were printed.

[Charge Amount Ratio]

The measurement was made with use of a charge amount measuring device (trade name: 210HS-2A, manufactured by Trek Japan KK). The two-component developer dispensed from the color multi-functional peripheral was put in a metal-made container equipped with a 500-mesh conductive screen at the bottom, only the toner was sucked with a suction machine under a suction pressure of 250 mmHg (33250 Pa), and the charge amount of the toner was determined from difference between weight of the two-component developer before suction and weight of the two-component developer after suction, and potential difference between capacitor polar plates connected to the container. On the basis of the following expression (4), a proportion to the initial charge amount of the toner (charge amount of the toner before performing the performance evaluation) was calculated as a charge amount ratio, and the charge amount ratio was evaluated by the following standards.

$$\text{Charge amount ratio (\%)}=\{\text{Charge amount of toner (}\mu\text{C/g)/Initial charge amount of toner (}\mu\text{C/g)}\}\times 100 \quad (4)$$

Evaluation standards of the charge amount ratio are as follows.

Good: Favorable. A charge amount ratio is 80% or more.

Not bad: No problem with practical use. A charge amount ratio is 70% or more and less than 80%.

Poor: No good. A charge amount ratio is less than 70%.

[Image Density]

A solid image with 3 cm on a side was printed at 100% density, and the image density of a printed part was measured with use of a reflective densitometer (trade name: RD918, manufactured by GretagMacbeth), which was evaluated by the following standards.

Evaluation standards of the image density are as follows.

Good: Favorable. The image density is 1.4 or more.

Not bad: No problem with practical use. The image density is 1.2 or more and less than 1.4.

Poor: No good. The image density is less than 1.2.

[Fog Density]

Whiteness of a non-image region (0% density) was measured with use of a whiteness meter (trade name: Z-590 COLOR MEASURING SYSTEM, manufactured by Nippon Denshoku Industries Co., Ltd.) to obtain difference from whiteness before printing that has been measured in advance, which difference is served as fog density and evaluation was made based on the following standards.

Evaluation standards of the fog density are as follows.

Good: Favorable. The fog density is less than 0.5. A fog can be hardly confirmed by the naked eye.

Not bad: No problem with practical use. The fog density is 0.5 or more and less than 1.0. A fog can be slightly confirmed by the naked eye.

Poor: No good. The fog density is more than 1.0. A fog can be clearly confirmed by the naked eye.

With use of evaluation results of the charge amount ratio, the image density and the fog density, charging stability was evaluated by the following standards.

Good: The evaluation results of the charge amount ratio, the image density and the fog density are rated as "Good".

Not bad: Among the evaluation results of the charge amount ratio, the image density and the fog density, at least one evaluation result is rated as "Not bad", but no evaluation results are rated as "Poor".

Poor: Among the evaluation results of the charge amount ratio, the image density and the fog density, at least one evaluation result is rated as "Poor".

<Comprehensive Evaluation>

With use of evaluation results of the preservation stability and the charging stability, comprehensive evaluations were made by the following comprehensive evaluation standards.

Good: Favorable. Evaluation results of the preservation stability and the charging stability are rated as "Good".

Not bad: No problem with practical use. Among the evaluation results of the preservation stability and the charging stability, at least one evaluation result is rated as "Not bad", but no evaluation results are rated as "Poor".

Poor. No good. Among the evaluation results of preservation stability and charging stability, at least one evaluation result is rated as "Poor".

Table 1 shows the evaluation results and the like. In Table 1, the polyester resin A1 is indicated as a resin A1, the polyester resin A2 is indicated as "resin A2", the polyester resin B is indicated as "resin B", the benzilic acid compound A is indicated as "compound A", and the benzilic acid compound B is indicated as "compound B".

TABLE 1

| | | | Example 1 | Example 2 | Example 3 | Example 4 | Example 5 |
|---|---|---|---|---|---|---|---|
| Binder resin | | Type | Resin A1<br>Resin B | Resin A2<br>Resin B | Resin A1<br>Resin B | Resin A1<br>Resin B | Resin A1<br>Resin B |
| Benzilic acid compound | | Type | Compound A | Compound A | Compound A | Compound A | Compound A |
| | | Additive amount (part by weight) | 1.3 | 1.3 | 0.9 | 2.6 | 0.8 |
| | | Content (part by weight) relative to 100 parts by weight of binder resin | 1.5 | 1.5 | 1.0 | 2.9 | 0.9 |
| Rosin content (% by weight) in sum of starting materials of resin A | | | 62.5 | 71.3 | 62.5 | 62.5 | 62.5 |
| Preservation stability | | Mesh-up ratio (%) | 8 | 9 | 8 | 7 | 13 |
| | | Evaluation | Good | Good | Good | Good | Not bad |
| Charging stability | Charge amount | Charge amount ratio (%) | 84 | 83 | 83 | 85 | 81 |
| | | Evaluation | Good | Good | Good | Good | Good |
| | Image density | Image density | 1.5 | 1.5 | 1.5 | 1.5 | 1.3 |
| | | Evaluation | Good | Good | Good | Good | Not bad |
| | Fog density | Fog density | 0.4 | 0.4 | 0.4 | 0.4 | 0.4 |
| | | Evaluation | Good | Good | Good | Good | Good |
| Comprehensive evaluation of charging stability | | | Good | Good | Good | Good | Not bad |
| Comprehensive evaluation | | | Good | Good | Good | Good | Not bad |

| | | Example 6 | Example 7 | Example 8 | Comparative Example 1 | Comparative Example 2 |
|---|---|---|---|---|---|---|
| Binder resin | Type | Resin A1<br>Resin B | Resin A1<br>Resin B | Resin A1<br>Resin B | Resin A1<br>Resin B | Resin A1<br>Resin B |
| Benzilic acid compound | Type | Compound A | Compound A | Compound A | — | — |
| | Additive amount (part by weight) | 2.7 | 1.3 | 1.3 | 0 | 0 |
| | Content (part by weight) relative to 100 parts by weight of binder resin | 3.1 | 1.5 | 1.5 | — | — |

TABLE 1-continued

| | | | | | | | |
|---|---|---|---|---|---|---|---|
| Rosin content (% by weight) in sum of starting materials of resin A | | | 62.5 | 62.5 | 62.5 | 62.5 | 62.5 |
| Preservation stability | | Mesh-up ratio (%) | 7 | 15 | 9 | 32 | 32 |
| | | Evaluation | Good | Not bad | Good | Poor | Poor |
| Charging stability | Charge amount | Charge amount ratio (%) | 77 | 83 | 78 | 73 | 82 |
| | | Evaluation | Not bad | Good | Not bad | Not bad | Good |
| | Image density | Image density | 1.6 | 1.2 | 1.3 | 1.2 | 1.2 |
| | | Evaluation | Good | Not bad | Not bad | Not bad | Not bad |
| | Fog density | Fog density | 0.5 | 0.5 | 0.4 | 0.6 | 0.5 |
| | | Evaluation | Not bad | Not bad | Good | Not bad | Not bad |
| Comprehensive evaluation of charging stability | | | Not bad | Not bad | Not bad | Not bad | Not bad |
| Comprehensive evaluation | | | Not bad | Not bad | Not bad | Poor | Poor |

In Examples 1 to 4, since a boron compound having benzyl acid as ligand was used and the additive amount thereof was appropriate, good results of preservation stability and charging stability were obtained. However, in Example 5, preservation stability and charging stability were slightly inferior because of a small additive amount of the benzilic acid compound, and in Example 6, charging stability was slightly decreased because of a large additive amount of the benzilic acid compound. Further, in Example 7 in which the boron compound having benzyl acid as ligand was not used, charging stability was slightly inferior, and in Comparative Examples 1 and 2 in which the benzilic acid compound is not included, preservation stability was decreased compared to that of the examples. Additionally, when Example 1 in which the benzilic acid compound was mixed into a master batch is compared to Example 8 in which the benzilic acid compound was added in the same amount and not mixed into a master batch, preservation stability and charging stability of Example 8 were slightly inferior.

These results show that a toner comprising a binder resin containing the polyester resin A obtained by subjecting aromatic dicarboxylic acid, rosin and trivalent or higher-valent alcohol as materials to polycondensation, a content of the rosin in the materials being 60% by weight or more, and the polyester resin B obtained by subjecting aromatic dicarboxylic acid and polyhydric alcohol as materials to polycondensation; a colorant; and a benzilic acid compound has good preservation stability and charging stability, and the benzilic acid compound is added in an amount of 1 part by weight or more and 3 parts by weight or less relative to 100 parts by weight of the binder resin, and is mixed into a master batch, so that it is possible to further improve the effect.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner comprising:

a binder resin containing a polyester resin A obtained by subjecting aromatic dicarboxylic acid, rosin and trivalent or higher-valent alcohol as starting materials to polycondensation, a content of the rosin in a sum of the starting materials being 60% by weight or more, and a polyester resin B, which does not include rosin, obtained by subjecting aromatic dicarboxylic acid and polyhydric alcohol as starting materials to polycondensation;

a colorant; and a benzilic acid compound, which is a boron compound having benzyl acid as ligand and is contained in an amount of 1 part by weight or more and 3 parts by weight or less relative to 100 parts by weight of the binder resin, wherein the toner is formed of an admixture of a master batch which contains the polyester resin A, the colorant and the benzilic acid compound, and the polyester resin B.

2. The toner of claim 1, wherein the polyester resin A is obtained by subjecting rosin, aromatic dicarboxylic acid which includes terephthalic acid and/or isophthalic acid, and higher-valent alcohol which includes glycerin as starting materials to polycondensation, and the polyester resin B is obtained by subjecting aromatic dicarboxylic acid which includes terephthalic acid and/or isophthalic acid, and higher-valent alcohol which includes glycerin and bisphenol A alkylene oxide as starting materials to polycondensation.

* * * * *